United States Patent [19]

Nagel, Jr.

[11] Patent Number: 4,473,945

[45] Date of Patent: Oct. 2, 1984

[54] SCISSORS POSITIONED VACUUM HAIRCUTTING APPARATUS AND METHOD

[76] Inventor: Frederick W. Nagel, Jr., Clay Court, Rhinebeck, N.Y. 12572

[21] Appl. No.: 401,410

[22] Filed: Jul. 23, 1982

[51] Int. Cl.[3] ..... B26B 19/44

[52] U.S. Cl. ..... 30/133; 30/201

[58] Field of Search ..... 30/133, 201, 131, 41.5

[56] References Cited

U.S. PATENT DOCUMENTS

| | | | |
|---|---|---|---|
| B 581,843 | 3/1976 | Alevrds | 30/133 |
| 3,505,732 | 4/1970 | Trapani | 30/133 |
| 3,606,681 | 9/1971 | Rogers | 30/133 |
| 4,005,525 | 2/1977 | Clay | 30/133 |
| 4,188,720 | 2/1980 | Korf | 30/133 |
| 4,261,102 | 4/1981 | Andriotis | 30/133 |
| 4,380,870 | 4/1983 | Otto | 30/133 |

*Primary Examiner*—Jimmy C. Peters

[57] ABSTRACT

An apparatus for cutting hair that is comprised of a triangular housing, enclosing open scissor blades, from whose opposing flat sides are projected hollow tubes, one having several fitted extensions, the other having affixed to it a flexible plastic hose, tapered at the end, so that it is insertable into a vacuum suction device, thus supplying suction so that, with the extensioned tube placed on the subject's scalp, hair will be drawn up, through the housing and between open scissor blades, where it is cuttable at lengths dependent on the extensions used. A method of scissor positioned, vacuum haircutting employing this device.

4 Claims, 3 Drawing Figures

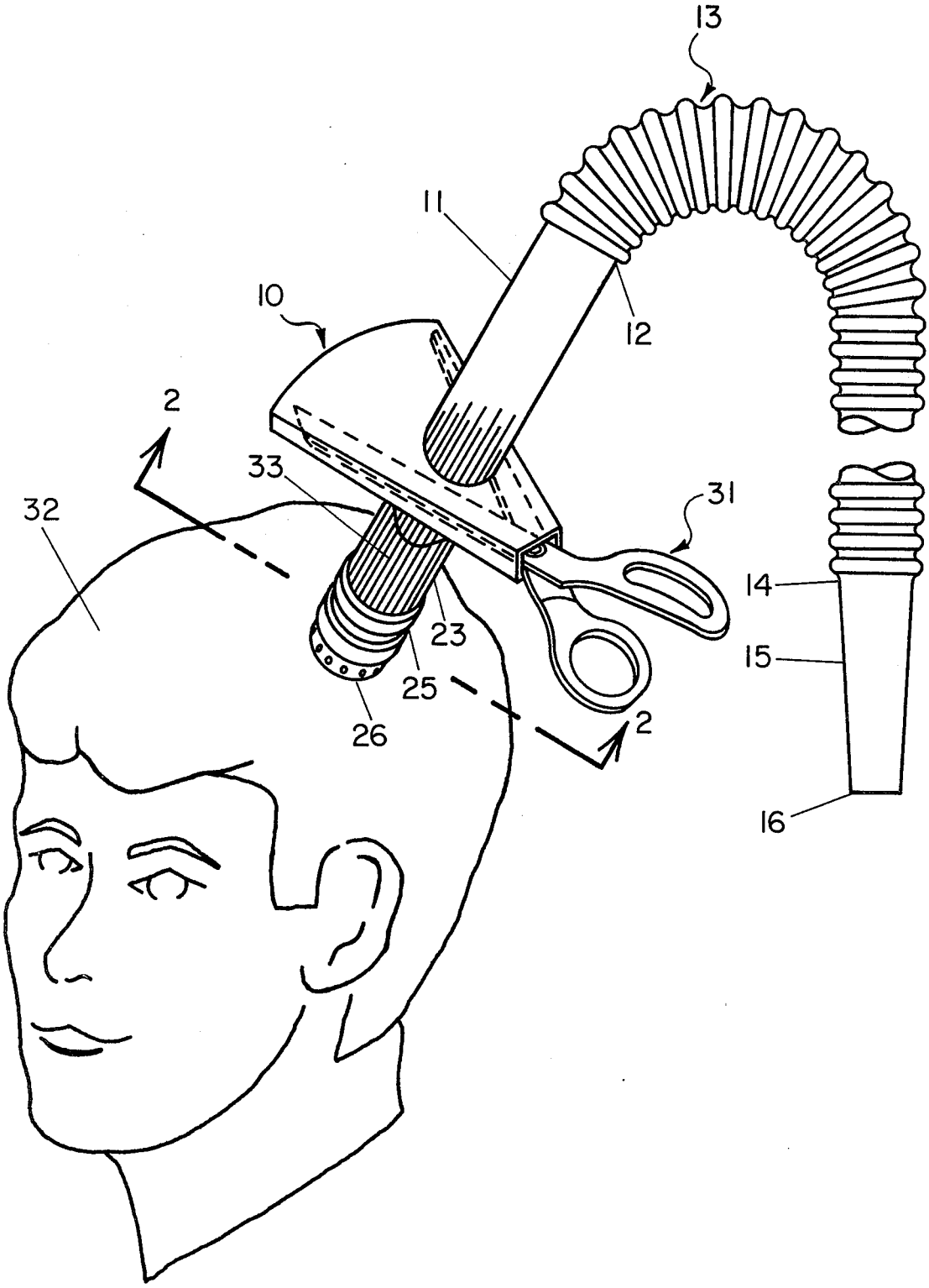
FIG. I

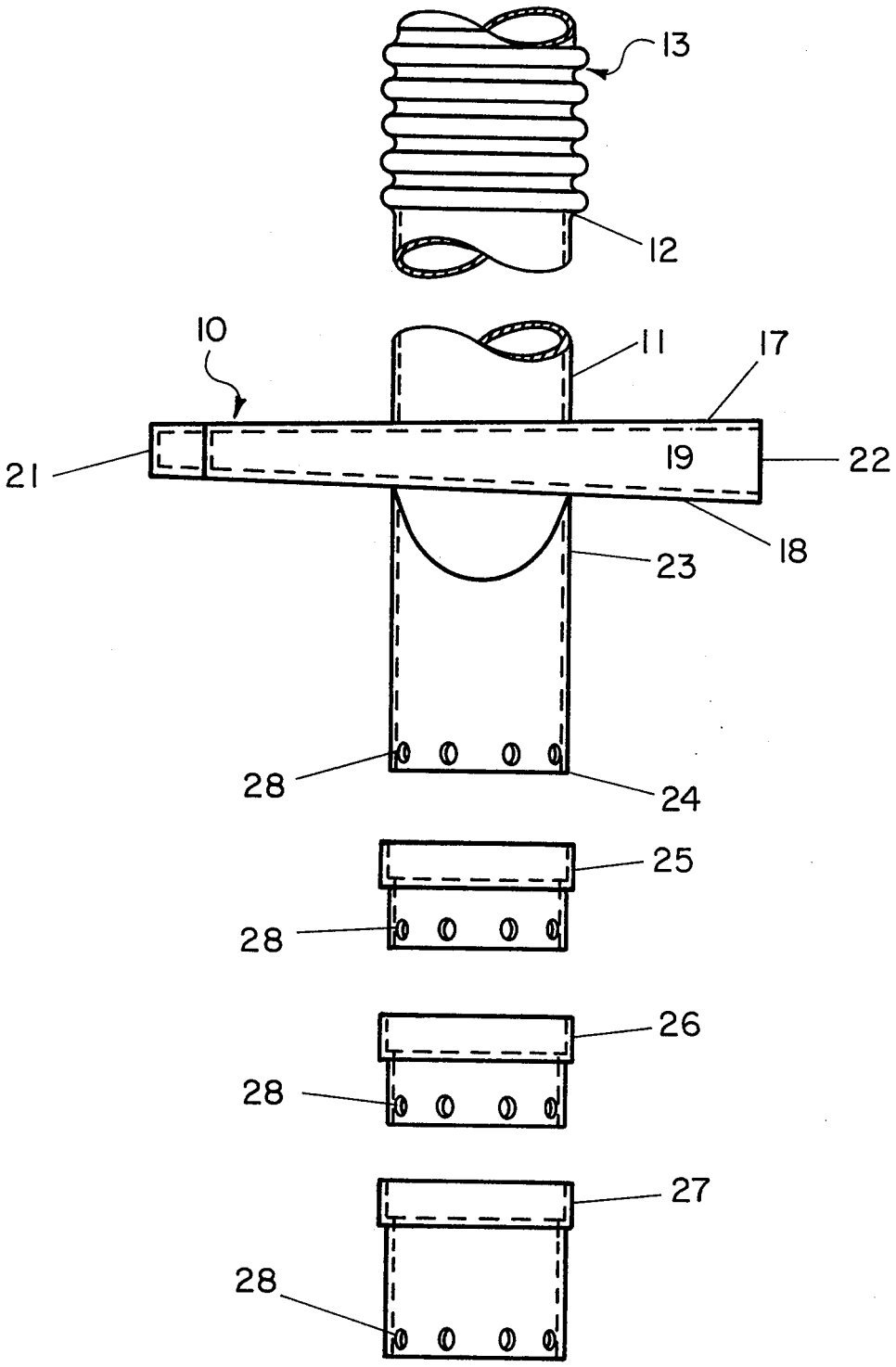
FIG. II

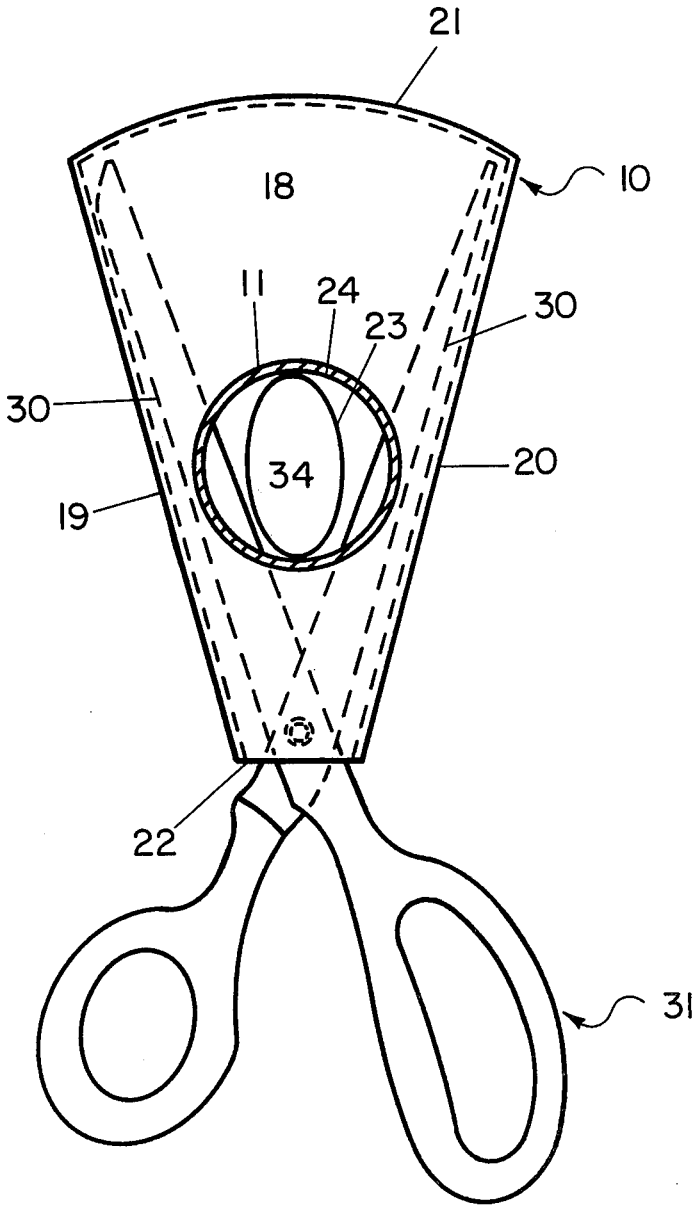
FIG. III

SCISSORS POSITIONED VACUUM HAIRCUTTING APPARATUS AND METHOD

This invention relates to an apparatus that holds scissor blades, in the open position, a fixed distance from the subject's scalp and that employs suction to draw hair between the blades where the hair is then cuttable. This invention relates also to a method for cutting hair, using scissors so positioned.

Haircutting, using the vacuum suction method is not a new idea. Various patents have correctly alluded to the advantage of pulling hair to a given cuttable length using suction rather than using one's fingers, as does an artisan when giving a haircut. Vacuum haircutting devices, however, have failed to provide the average person with an uncomplicated, yet effective device and method to cut the hair of others, or to cut his own.

U.S. Pat. No. 3,536,079, 10/1970, Reynolds et al. (132-45) is an example of many such vacuum devices that are impractical for the average person, being neither affordable, nor easy to operate. Moreover, one cannot use such a device to cut one's own hair.

U.S. Pat. No. 4,000,562, 1/1977, Alevras (132-45R) is both simple and affordable to the average person, but it too has drawbacks. The necessity of re-inserting the scissors for each cut makes haircutting extremely tedious, given the number of times the device must be moved and the varying angles at which it must be held on the subject's scalp. Once inserted, the scissors are in a poor position to cut effectively, employing as they do the scissor tips, rather than the broader part of the blades nearer the handles. The operator of the device must also check each cut visually to make sure that all strands of hair have been severed, there being no way to insure that all strands are between the scissor blades before the cut. Finally, the need to continually reinsert the scissors for each cut makes this device impractical for cutting one's own hair.

The objectives that a device be simple to operate and affordable while being free from tedium and efficient to the point of allowing one to cut his own hair have been realized in the Scissors Positioned Vacuum Haircutting Apparatus and Method.

This invention includes an apparatus for cutting hair a uniform length that is comprised of a triangular housing for scissor blades, held in the open position, from whose opposing flat sides are projected hollow tubes, one of which has several fitted extensions (of varying lengths), the other of which is attached to a flexible plastic hose which in turn is attached to a tapered hollow tube, the small end being furthermost from the plastic hose, so that the tapered tube may be inserted into any one of a variety of vacuum suction devices, thus supplying suction so that, with the end of the tube with fitted extensions placed on the subject's scalp, said subject's hair will be drawn up, through the scissor housing and between the open scissor blades, where it is then cuttable at a length dependent on the number of fitted extensions having been affixed. This invention also includes a method of cutting hair using this scissor positioned, vacuum haircutting device.

BRIEF DESCRIPTION OF THE DRAWINGS

The invention will be displayed in the following drawings:

FIG. 1 is a perspective view of this invention, showing its use on a subject's head.

FIG. 2 is a side elevational cross-section of the invention in FIG. 1, along line 2—2 in the direction of the arrows.

FIG. 3 is a top plan view of the invention.

DESCRIPTION OF THE PREFERRED EMBODIMENTS

In reference to the drawings, there is shown the scissor housing 10, attached to a flexible plastic hose 13, which ends in a plastic tube 15, tapered so as to be insertable into any one of a number of different sized vacuum devices. The apparatus further comprises an elongated, round, hollow tube 11 which serves as a handle, attached at one end to the top of the scissor housing 17 and at the other end to the flexible plastic hose at 12. The hose 13 is long enough to reach from a seated person's head to the floor, where it attaches at 14 to the tapered tube 15. The circumference of the tapered tube at 14 is larger than any vacuum device opening, and the circumference at the other end 16 is smaller, insuring that the tube 15 is insertable into any such vacuum device made.

The scissor housing itself 10, is comprised of two flat surfaces 17 and 18 joined to each other by two opposing flat sides 19 and 20, and by one curved side 21. The remaining side 22 of the scissor housing is left open to allow for the insertion of the scissor blades 30. Surfaces 17 and 18 are further apart at side 22 than they are apart at side 21, thus following the taper of an inserted pair of scissors from the joining of its blades at 22 to the blade tips at 21.

Inserted into flat surface 18 of the scissor housing is an oval hollow tube 23, which is directly opposite the elongated, round, hollow tube 11. This oval hollow tube 23 expands to a round shape at its other end 24, so as to be insertable into one or more of the fitted extensions 25, 26, 27. Although the number and length of these extensions may vary, they are related in such a way as to provide the maximum number of possible distances from the scissor housing 10. Therefore, if the oval hollow tube at 24 is two inches from flat surface 18 of the scissor housing, then the attachment of extension 25 would bring the total distance from 18 to the end of the apparatus to two and a half inches. Removing extension 25 and adding extension 27 would bring the total distance to three inches. Adding extension 25 to extension 27 would bring the total to three and one half inches. Finally, adding extension 26 to the rest would bring the total to four inches. In all, five different lengths from the scissor housing are possible, all of which are equidistant from one another.

Each of the extensions, as well as the oval hollow tube 23 is ringed with small round holes 28, which are placed in such a way as to be covered by each succeeding extension that is affixed. At no time, regardless of the distance from 18 to the end of the apparatus (determined by the number of extensions used) will there be more than one ring of small round holes 28 left exposed. The function of these small holes 28 will be described below.

The scissor housing 10 with its attached tubes 11 and 23, and the fitted extensions 25, 26, and 27 are to be made of clear plastic. The flexible plastic hose 13 is to be strengthened by a spiralled wire on the inside. The tapered tube 15 is to be made of soft flexible plastic.

Describing the operation of this invention in the cutting of hair, tapered tube 15 is inserted into a vacuum suction device, thus creating suction at the opposite end of the device, oval hollow tube 23. With the number of fitted extensions added, according to the desired length of the haircut to be given, the open end is placed on the subject's scalp 32, so that his hair 33 is pulled up through the opening 34 in the scissor housing 10, where it is then cut a uniform length by scissor blades 30. Hair ends thus severed will be sucked through the flexible plastic hose 13, into the attached vacuum suction device. The small round holes 28 will then allow the haircutting device to be easily released from one spot on the subject's head and placed on another. Keeping the scissor blades 30 open at each move insures that they will be in exactly the right position for the next cut. In this way, the haircutting device can be moved rapidly around a subject's head until all hairs have been cut a uniform length. Moreover, since each cut does not have to be checked visually, and since there is no need to continually reinsert the scissors, a person may quite easily cut his own hair, with one hand on the elongated, round, hollow tube 11 and the other hand on the scissor handles 31.

What is claimed:

1. A vacuum haircutting apparatus comprising:

(A) a scissor housing made up of two triangular pieces of flat plastic, set parallel to one another and joined at the sides, so that said housing holds scissor blades in a fixed position, once said blades have been inserted and opened by the operator;

(B) a small opening at an acute angle of said housing allowing for the insertion of said pair of scissors;

(C) two opposing openings in the middle of the flat sides of said triangular housing leading to opposing hollow tubes, projecting from said sides;

(D) a flexible plastic hose attached to one of said projecting hollow tubes;

whereby the application of a source of vacuum to one end of said flexible hose while the other projecting hollow tube is applied to the subject's scalp, will result in the subject's hair being pulled through said tube, and through said triangular housing and between said open scissor blades, where it is then cuttable.

2. An apparatus according to claim 1 wherein the hollow tube nearest the subject's scalp has several fitted extensions of various lengths which allow the operator of said apparatus to choose, by affixing one or more of these extensions, a desired distance between the subject's scalp and the positioned scissors.

3. An apparatus according to claim 2 wherein the hollow tube furthest from the subject's scalp is attached to a flexible plastic hose long enough to reach from a seated person's head to the floor.

4. An apparatus according to claim 3 wherein the flexible plastic hose is attached to a tapered tube, whose circumference where it meets the hose is larger than any vacuum device opening, and whose circumference at the other end is smaller, insuring that the tube is insertable into any such vacuum device made.

* * * * *